US007205468B1

(12) United States Patent
Johnson

(10) Patent No.: US 7,205,468 B1
(45) Date of Patent: Apr. 17, 2007

(54) COMBINATION GUITAR ARM REST AND LEG REST FOR IMPROVED GUITAR SOUND RESONANCE

(76) Inventor: Timothy L. Johnson, P.O. Box 18884, Denver, CO (US) 80218

( * ) Notice: Subject to any disclaimer, the term of this patent is extended or adjusted under 35 U.S.C. 154(b) by 88 days.

(21) Appl. No.: 11/177,317

(22) Filed: Jul. 11, 2005

(51) Int. Cl.
*G10D 3/00* (2006.01)

(52) U.S. Cl. ..... 84/327; 84/421; 84/453

(58) Field of Classification Search ..... 84/327, 84/328, 421, 453, 387 A, 280
See application file for complete search history.

(56) References Cited

U.S. PATENT DOCUMENTS

| | | | | | |
|---|---|---|---|---|---|
| 2,814,229 | A * | 11/1957 | Adelaide et al. | ..... | 84/327 |
| 3,955,461 | A * | 5/1976 | Ivie | ..... | 84/327 |
| 4,913,027 | A * | 4/1990 | Twohy | ..... | 84/280 |
| 4,966,062 | A * | 10/1990 | Driggers et al. | ..... | 84/327 |
| 5,208,409 | A * | 5/1993 | Roulet | ..... | 84/278 |
| 5,315,910 | A * | 5/1994 | Soupios | ..... | 84/453 |
| 5,388,492 | A * | 2/1995 | Olson | ..... | 84/327 |
| 5,528,971 | A * | 6/1996 | Wood | ..... | 84/327 |
| 6,005,175 | A * | 12/1999 | Johnson | ..... | 84/327 |
| 6,252,150 | B1 * | 6/2001 | Johnson | ..... | 84/327 |

* cited by examiner

*Primary Examiner*—Ross Gushi
(74) *Attorney, Agent, or Firm*—Edwin H. Crabtree; Ramon L. Pizarro

(57) ABSTRACT

A combination guitar arm rest and leg rest for attachment to a portion of a body of a guitar and holding the guitar away from a guitar player's arm or elbow and above the player's leg. The combination includes an arm rest pad and a leg rest pad. The arm rest pad and the leg rest pad are pivotally attached to a tang. The tang is pivotally mounted on a yoke. The yoke is pivotally attached to one end of a pair of struts. An opposite end of the struts is pivotally mounted on a suction cup pivot pin. Opposite ends of the pivot pin are attached to a pair of suction cups. The suction cups are adapted for releasable attachment to the body of the guitar. The tang, the yoke and the struts allow the arm rest pad and the leg rest pad to be pivoted in an "XY" vertical plane, a "YZ" vertical plane and a "XZ" horizontal plane for infinite adjustments by the guitar player.

20 Claims, 3 Drawing Sheets

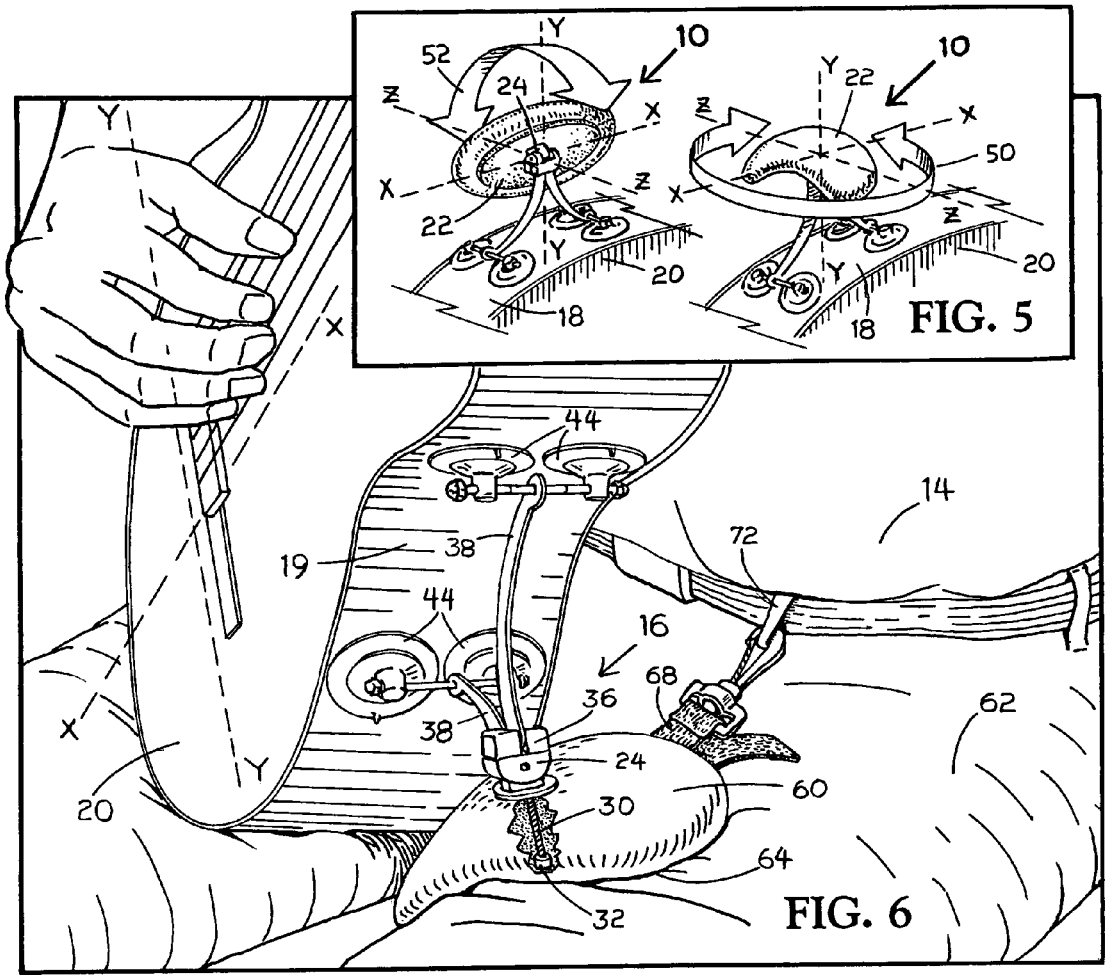
FIG. 5
FIG. 6
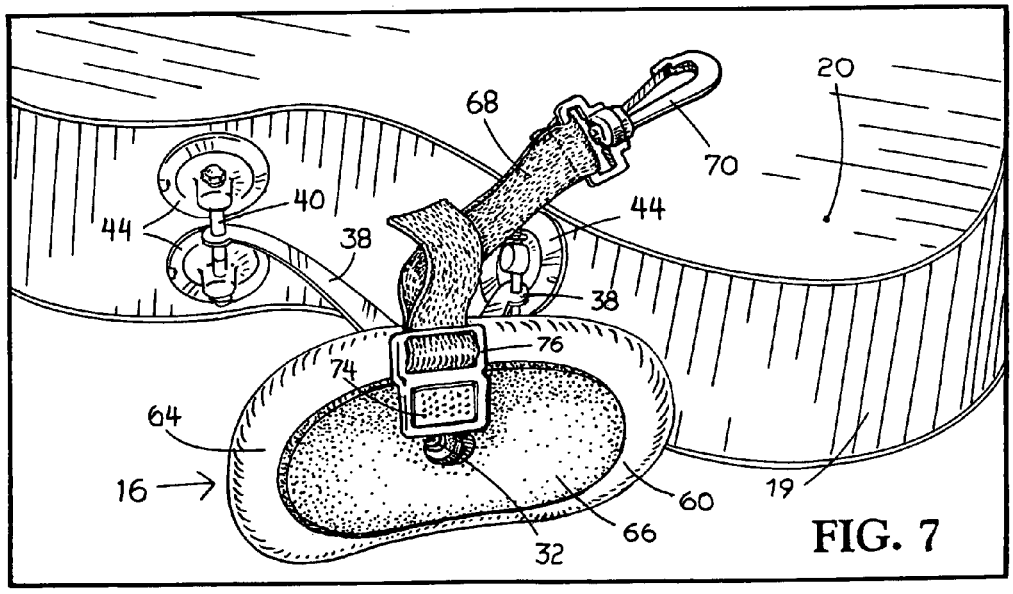
FIG. 7

COMBINATION GUITAR ARM REST AND LEG REST FOR IMPROVED GUITAR SOUND RESONANCE

BACKGROUND OF THE INVENTION (a) Field of the Invention

This invention relates to a guitar arm rest and leg rest used when playing a guitar and more particularly, but not by way of limitation, to a combination guitar arm rest and guitar leg rest releasably attached to a guitar for improved guitar sound resonance.

(b) Discussion of the Prior Art

In U.S. Pat. No. 6,005,175 to the subject inventor, a guitar fulcrum is disclosed and used as an elbow rest for an elbow of a right or left arm of a guitar player when playing a guitar. This guitar fulcrum allows for the proper placement of a player's fingers on the guitar strings adjacent a sweet spot above the sound hole of the guitar. This patent discloses pivot movement of an elbow pad in a "XY" vertical plane and height adjustment in this plane. But, the patent doesn't disclose the use of a tang and yoke that allows the elbow pad to pivot in a "XZ" horizontal plane and in a "YZ" vertical plane.

In U.S. Pat. No. 6,252,150 to the subject inventor, another guitar fulcrum is described for attaching to a body of a guitar and holding the guitar above a guitar player's leg when the player is in a seated position. The guitar fulcrum includes a curved leg pad with soft cushion material for receipt on top of the player's leg. The fulcrum allows for adjusting and moving the guitar in three-dimensions prior to playing or during the playing of the guitar. This patent discloses the pivot features of moving a leg pad in a "XY" vertical plane, a "YZ" vertical plane and a "XZ" horizontal plane.

The subject guitar arm rest and leg rest combines the structure and function of the above mentioned patented guitar fulcrums for the elbow and leg plus additional features as described herein. The new combination guitar arm rest and leg rest provides for improved player performance during guitar playing.

SUMMARY OF THE INVENTION

In view of the foregoing, it is a primary objective of the subject invention to provide for a greatly improved guitar sound resonance and better tone quality when playing a guitar. The invention eliminates an arm, an elbow and a leg resting against a portion of the guitar during a musical performance. Also, the player's fingers are properly placed on guitar strings above the sound hole of the guitar.

Another object of the invention is both the arm rest and leg rest are adjustable in three dimensions for infinite adjustments for different size guitar players having different arm lengths and different types and styles of playing. The adjustments of the two rests can be made in a vertical "XY" plane, a vertical "YZ" plane and a horizontal "XZ" plane. Also, the rests include different lengths of struts for proper height adjustments of an arm rest pad and a leg rest pad from an upper side and lower side of the guitar.

Yet another object of the combination guitar arm rest and leg rest is the leg rest includes a leg rest strap for preventing the leg rest from moving on the player's leg when sitting in different positions.

Still another object of the invention is to provide a guitar player with an ergonomically designed arm rest and leg rest for increased arm and leg comfort during an extended musical performance.

The combination guitar arm rest and leg rest for attachment to a portion of a body of a guitar and holding the guitar away from a guitar player's arm or elbow and above the player's leg. The combination includes an arm rest pad and a leg rest pad. The arm rest pad and the leg rest pad are pivotally attached to a tang. The tang is pivotally mounted on a yoke. The yoke is pivotally attached to one end of a pair of struts. An opposite end of the struts is pivotally mounted on a suction cup pivot pin. Opposite ends of the pivot pin are attached to a pair of suction cups. The suction cups are adapted for releasable attachment to the body of the guitar. The tang, the yoke and the struts allow the arm rest pad and the leg rest pad to be pivoted in an "XY" vertical plane, a "YZ" vertical plane and a "XZ" horizontal plane for infinite adjustments by the guitar player.

These and other objects of the present invention will become apparent to those familiar with various types of musical instrument arm rests, leg rests and like musical instrument accessories when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which:

FIG. 5 illustrates the arm rest pad ability to be pivoted toward and away from the guitar player in a "YZ" vertical plane and pivoted 360 degrees in a "XZ" horizontal plane.

FIG. 6 is a perspective view on a leg rest, which is part of the combination guitar arm rest and leg rest. The leg rest is shown resting on a portion of a guitar player's leg. The leg rest includes a leg rest pad, a tang, a yoke, a pair of height adjustment struts and suction cups. The suction cups are shown releasably attached to a lower side portion of a body of a guitar.

FIG. 7 is a perspective view of a bottom of the leg rest with a bottom of the leg rest pad having a soft cushion. Attached to the leg rest pad in an adjustable leg rest strap. The leg rest strap is used for releasable attachment to a belt loop or other article of clothing on the guitar player. The leg rest strap is used to prevent slippage of the leg rest pad on the player's leg during a musical performance.

DETAILED DESCRIPTION OF THE PREFERRED EMBODIMENTS

Figure 1:
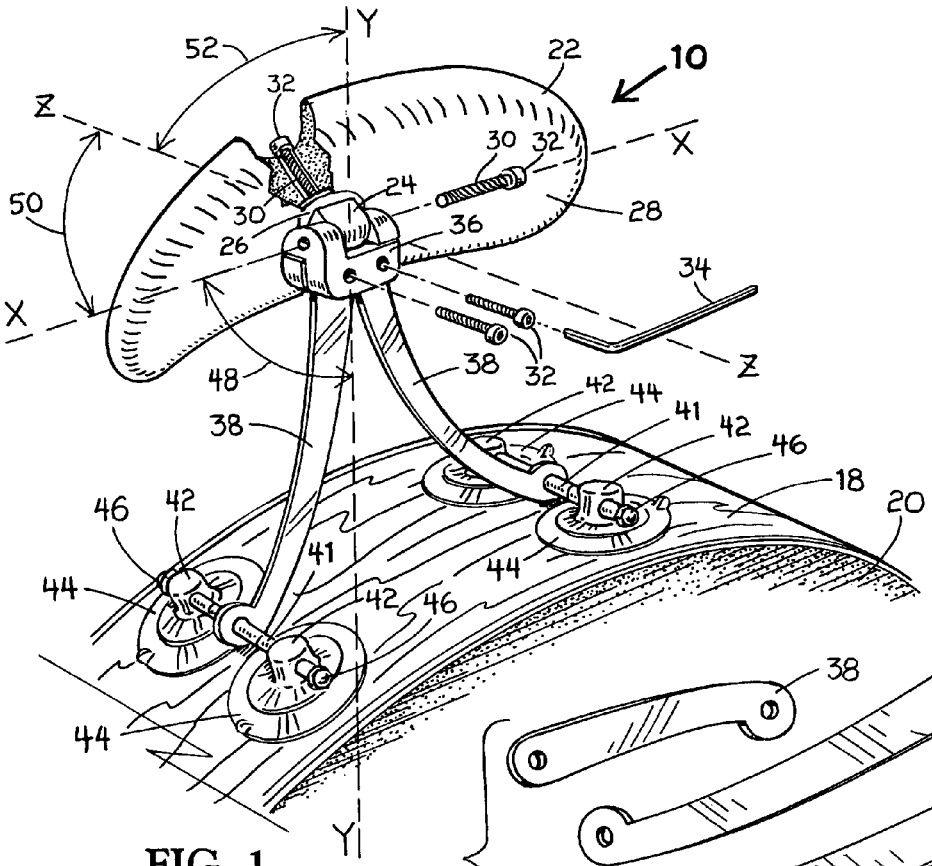
FIG. 1 is a perspective view of the arm rest, which is part of the combination guitar arm rest and leg rest. The arm rest includes an arm rest pad, a tang, a yoke, a pair of height adjustment struts and suction cups. The suction cups are shown releasably attached to an upper side of a body of a guitar.
Figure 7A:
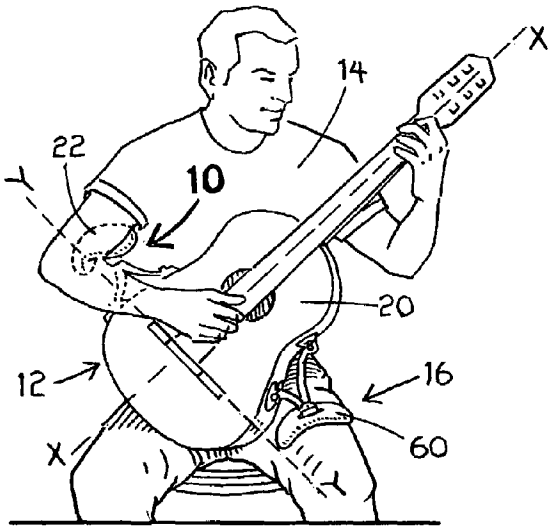
FIG. 7A is a front perspective view of the guitar player in a seated position using the combination guitar arm rest and leg rest with the guitar positioned in a standard playing position.
Figure 7B:
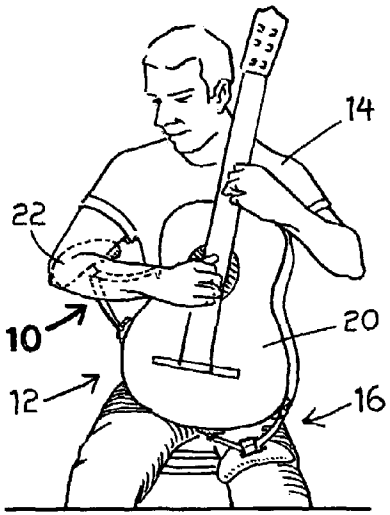
FIG. 7B is a front perspective view of the guitar player in a seated position using the combination guitar arm rest and leg rest with the guitar in a raised positioned.
Figure 7C:
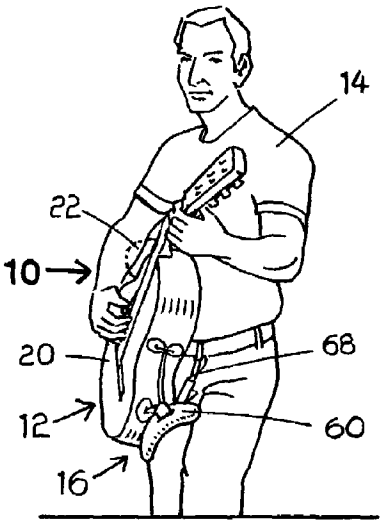
FIG. 7C is a front perspective view of the guitar player in a standing position using the combination guitar arm rest and leg rest with the guitar positioned in a standard playing position.

In FIG. 1, a perspective view of an arm rest, having a general reference numeral 10, is shown. The arm rest 10 is part of a combination guitar arm rest and leg rest, having general reference numeral 12. The combination 12 is shown in FIGS. 7A–7C being used by a guitar player 14 with the arm rest 10 and a leg rest 16 mounted on an upper side 18 and a lower side 19 of a guitar 20. As mentioned above, by using the unique combination 12 of both the arm rest 10 and the leg rest 16, the guitar 20 is free from contact against a portion of a player's body. This key feature provides for improved resonance and tone quality when playing the guitar. Also, the arm rest 10 provides for proper adjustment of the player's fingers on the guitar strings above the sound hole in the guitar 20 as described in the applicant's patent, U.S. Pat. No. 6,005,175.

Figure 4:
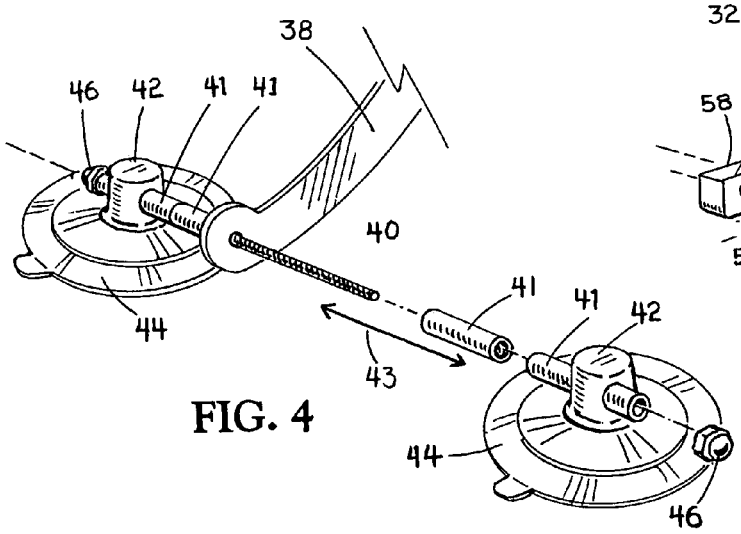
FIG. 4 is an exploded view of a threaded suction cup pivot pin received through tubular spacers and attached to a base of a pair of suction cups.

The arm rest 10 includes a rounded ergonomic designed arm rest pad 22 pivotally attached to the top of a tang 24 and washer 26. The tang 24 and washer 26 are attached to a bottom 28 of the pad 22 using a threaded screw 30 with hex screw head 32. A portion of the arm rest pad 22 is shown cutaway to show the screw 30 attached to the top of the tang 24. In this drawing, an Allen wrench 34 is shown for engaging the hex screw head 32 for tightening and loosening attachment screws 30 on the arm rest 10 and the leg rest 16. The tang 24 is pivotally attached to a top of a yoke 36 using a screw 30. A bottom of the yoke 36 is pivotally attached to one end of a pair of struts 38 using a pair of screws 30. An opposite end of the struts 38 is pivotally attached and centered on a threaded suction cup pivot pin 40 with tubular spacers 41. The threaded pivot pin 40 is shown in FIG. 4. Opposite ends of the threaded pivot pins 40 are attached to a base 42 of suction cups 44 using threaded hex nuts 46. The suction cups 44 are releasably attached to the upper side 18 of the guitar 20.

In this drawing, a vertical "Y" axis, a horizontal "X" axis and a horizontal "Z" axis are shown through the center of the tang 24. Obviously, the "X" and "Y" axis form a vertical "XY" plane indicated by arrow 48, the "X" and "Z" axis form a horizontal plane, indicated by arrow 50 and the "Y" and "Z" axis form another vertical plane, indicated by arrow 52. As mentioned above, the arm rest 10 and the leg rest 16 operate and pivot in all three planes 48, 50 and 52 for infinite adjustments by the guitar player 14 when using the subject invention.

Figure 2:
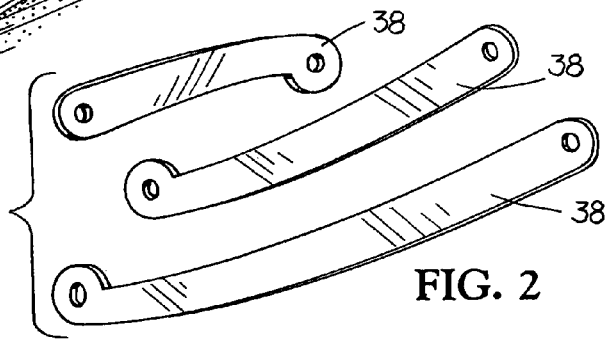
FIG. 2 is a perspective view of three struts having different lengths for different height adjustments of the arm rest pad and the leg rest pad.

In FIG. 2, a perspective view of three struts 38 is shown having different lengths for different height adjustments of the arm rest 10 and the leg rest 16. For example, the smaller strut 38 can have a length of 2 inches, the middle length strut can have a length of 3 inches and the larger strut 38 can have a length of 4 inches.

Figure 3:
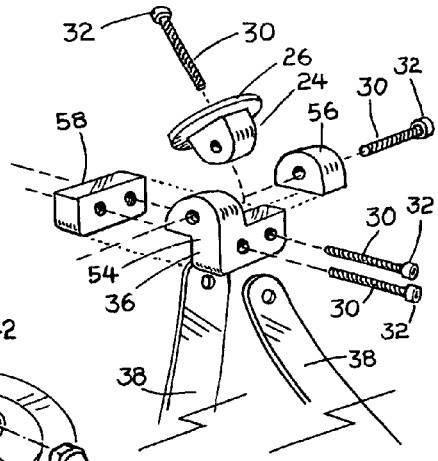
FIG. 3 is an exploded view of a three piece yoke, a tang, an end portion of two struts and attachment screws.

In FIG. 3, an exploded view of the yoke 36, the tang 24, an end portion of two struts 38 and the threaded screws 30 are shown. In this drawing, the yoke 36 is divided into three pieces. The pieces are a yoke body 54, a removable yoke arm 56 and a removable yoke base 58. The removable yoke arm 56 allows for different widths of tangs 24 attached thereto. The removable yoke base 58 allows for different widths of struts 38 attached thereto.

In FIG. 4, an exploded view of the threaded suction cup pivot pin 40 is shown received through the tubular spacers 41. Two of the spacers 41 are shown received through the base 42 of a pair of the suction cups 44 and attached thereto using the hex nuts 46.

It should be noted that by adjusting the number of spacers 41 on opposite sides of the lower end of the strut 38, the strut can be moved to the left or right, as indicated by arrow 43, on the upper side 18 or lower side 19 of the guitar 20. In this drawing, two spacers 41 are shown on the left side of the strut and two spacers 41 on the right side of the strut. Obviously, by removing the hex nuts 46, three spacers 41 can be placed on one side of the strut and the other spacer 41 placed on the opposite side of the strut. In this manner, the struts 38 can be adjusted laterally on the sides of the guitar.

In FIG. 5, the arm rest pad 22 is shown pivoted toward and away from the guitar player in the "YZ" vertical plane 52. Also the pad 22 is shown pivoted 360 degrees in a "XZ" horizontal plane 50.

In FIG. 6, a perspective view on the leg rest 16, which is part of the combination guitar arm rest and leg rest 12, is shown with an rounded ergonomic designed leg rest pad 60. The leg rest pad 60 is shown resting on a portion of a guitar player's leg 62. A portion of the leg rest pad 60 is shown with a threaded screw 32 pivotally attached to a tang 24 in a bottom 64 of the pad 60. The tang 24 is pivotally attached to a yoke 36. The yoke 36 is pivotally attached to one end of a pair of height adjustment struts 38. An opposite end of the struts 38 is attached to a suction cup pivot pin 40 mounted on a pair of suction cups 44. The suction cups 44 are shown releasably attached to the lower side 19 of the guitar 20.

In FIG. 7, a perspective view of the bottom 64 of the leg rest pad 60 is shown having a soft cushion 66 mounted thereon. Attached to the leg rest pad 60 is one end of an adjustable leg rest strap 68. An opposite end of the leg rest strap 68 includes a clip 70 used for releasable attachment to a belt loop 72, shown in FIG. 6, or other article of clothing on the guitar player 14. The leg rest strap 68 also includes a buckle clip 74 for releasable engagement to a buckle 76 attached to the pad 60. The length of the strap 68 is adjustable on the buckle 76. The leg rest strap 68 is used to prevent slippage of the leg rest pad 60 on the player's leg 62 during a musical performance.

In FIG. 7A, a front perspective view of the guitar player 14 is shown in a seated position using the combination guitar arm rest and leg rest 12. In this drawing, the guitar 20 is positioned in a standard playing position.

In FIG. 7B, a front perspective view of the guitar player 14 is shown in a seated position using the combination guitar arm rest and leg rest 12 with the guitar 20 in a raised positioned.

In FIG. 7C, a front perspective view of the guitar player 14 is shown in a standing position using the combination guitar arm rest and leg rest 12. In this drawing, the leg rest strap 68 is shown holding the leg rest pad 60 in front of the guitar player 14.

Figure 8A:
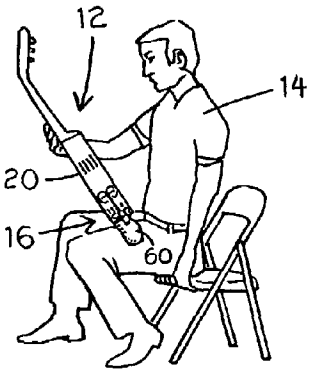
FIG. 8A is a side perspective view of the guitar player in a seated position using the combination guitar arm rest and leg rest with the guitar pivoted on the leg rest and away from the body of the player.

In FIG. 8A, a side perspective view of the guitar player 14 is shown in a seated position using the combination guitar arm rest and leg rest 12 with the guitar 20 pivoted on the leg rest 16 and away from the body of the player.

Figure 8B:
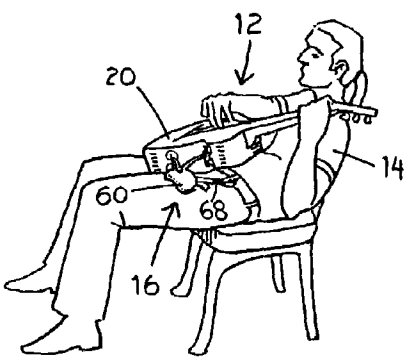
FIG. 8B is a side perspective of the guitar player in a seated position with the guitar lower and the leg rest strap preventing the guitar from slipping on the leg of the guitar player.

In FIG. 8B, a side perspective of the guitar player 14 is shown in a seated position with the guitar lowered and the leg rest strap 68 preventing the guitar 20 from slipping on the leg 62 of the guitar player 14.

Figure 8C:
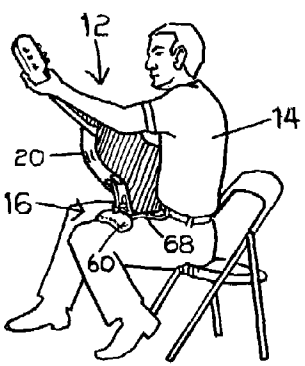
FIG. 8C is a side perspective view of the guitar player in a seated position using the combination guitar arm rest and leg rest with the guitar pivoted on the leg rest toward the right side of the body of the player.

In FIG. 8C, a side perspective view of the guitar player 14 is shown in a seated position using the combination guitar arm rest and leg rest 12 with the guitar 20 pivoted on the leg rest 16 toward the right side of the body of the player.

Figure 8D:
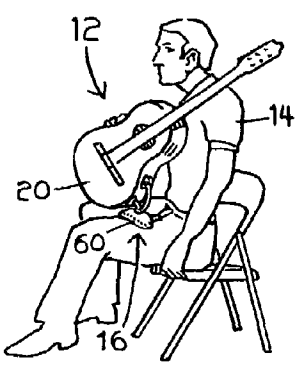
FIG. 8D is a side perspective of the guitar player in a seated position in a seated position using the combination guitar arm rest and leg rest with the guitar pivoted on the leg rest toward the left side of the player.

In FIG. 8D, a side perspective of the guitar player 14 is shown in a seated position in a seated position using the combination guitar arm rest and leg rest 12 with the guitar 20 pivoted on the leg rest 16 toward the left side of the body of the player.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A combination guitar arm rest and leg rest, the combination adapted for attachment to a side of a guitar and holding the guitar away from a guitar player's arm or elbow and above the player's leg, the combination comprising:

an arm rest pad pivotally attached to a first tang, said first tang pivotally mounted on a first yoke, said first yoke pivotally attached to one end of a pair of first struts, an opposite end of said first struts pivotally mounted on a first suction cup pivot pin, opposite ends of said first pivot pin attached to a pair of first suction cups, said first suction cups adapted for releasable attachment to an upper side of the guitar;

a leg rest pad pivotally attached to a second tang, said second tang pivotally mounted on a second yoke, said second yoke pivotally attached to one end of a pair of second struts, an opposite end of said second struts pivotally mounted on a second suction cup pivot pin, opposite ends of said second pivot pin attached to a pair of second suction cups, said second suction cups adapted for releasable attachment to a lower side of the guitar; and a leg rest strap, one end of said strap attached to said leg rest pad, an opposite end of said strap adapted for attachment to an article of clothing on the guitar player.

2. The combination as described in claim 1 wherein said first tang, said first yoke and said first struts allow said arm rest pad to be pivoted in an "XY" vertical plane, a "YZ" vertical plane and a "XZ" horizontal plane for infinite adjustments by the guitar player.

3. The combination as described in claim 1 wherein said second tang, said second yoke and said second struts allow said leg rest pad to be pivoted in an "XY" vertical plane, a "YZ" vertical plane and a "XZ" horizontal plane for infinite adjustments by the guitar player.

4. The combination as described in claim 1 wherein said pair of first struts have different lengths for different height adjustments of said arm rest pad above the upper side of the guitar.

5. The combination as described in claim 1 wherein said pair of second struts have different lengths for different height adjustments of said leg rest pad above the lower side of the guitar.

6. A combination guitar arm rest and leg rest, the combination adapted for attachment to a side of a guitar and holding the guitar away from a guitar player's arm or elbow and above the player's leg, the combination comprising:

a rounded ergonomically designed arm rest pad pivotally attached to a first tang, said first tang pivotally mounted on a first yoke, said first yoke pivotally attached to one end of a pair of first struts, an opposite end of said first struts pivotally mounted on a first suction cup pivot pin, opposite ends of said first pivot pin attached to a pair of first suction cups, said first suction cups adapted for releasable attachment to an upper side of the guitar;

a round ergonomically leg rest pad pivotally attached to a second tang, said second tang pivotally mounted on a second yoke, said second yoke pivotally attached to one end of a pair of second struts, an opposite end of said second struts pivotally mounted on a second suction cup pivot pin, opposite ends of said second pivot pin attached to a pair of second suction cups, said second suction cups adapted for releasable attachment to a lower side of the guitar, a bottom of said leg rest pad including a soft cushion thereon; and an adjustable leg rest strap, one end of said strap attached to said leg rest pad, an opposite end of said strap attached to a clip, said clip adapted for attachment to an article of clothing on the guitar player.

7. The combination as described in claim 6 wherein said first tang, said first yoke and said first struts allow said arm rest pad to be pivoted in an "XY" vertical plane, a "YZ" vertical plane and a "XZ" horizontal plane for infinite adjustments by the guitar player.

8. The combination as described in claim 6 wherein said second tang, said second yoke and said second struts allow said leg rest pad to be pivoted in an "XY" vertical plane, a "YZ" vertical plane and a "XZ" horizontal plane for infinite adjustments by the guitar player.

9. The combination as described in claim 6 wherein said pair of first struts have different lengths for different height adjustments of said arm rest pad above the upper side of the guitar and in a "XY" vertical plane.

10. The combination as described in claim 6 wherein said pair of second struts have different lengths for different height adjustments of said leg rest pad above the lower side of the guitar and in a "XY" vertical plane.

11. The combination as described in claim 6 wherein said first and second yokes are three piece yokes having a yoke body, a removable yoke arm and a removable yoke base for attaching to different width tangs and different width struts.

12. The combination as described in claim 6 wherein said first and second pivot pins are received inside tubular spacers, two of said spacers received in a base of said first and second pair of suction cups, opposite ends of said first and second pivot pins attached to threaded nuts.

13. The combination as described in claim 12 wherein said first and second pivot pins are received inside four tubular spacers, two of said spacers disposed on one side of the opposite end of said first and second struts and two of said spacers disposed on an opposite side of the opposite end of said first and second struts.

14. The combination as described in claim 12 wherein said first and second pivot pins are received inside four tubular spacers, three of said spacers disposed on one side of the opposite end of said first and second struts and one of said spacers disposed on an opposite side of the opposite end of said first and second struts for lateral adjustment of said arm rest pad and said leg rest pad on the sides of the guitar.

15. A combination guitar arm rest and leg rest, the combination adapted for attachment to a side of a guitar and holding the guitar away from a guitar player's arm or elbow and above the player's leg, the combination comprising:

a rounded ergonomically designed arm rest pad pivotally attached to a first tang, said first tang pivotally mounted on a first yoke, said first yoke pivotally attached to one end of a pair of first struts, an opposite end of said first struts pivotally mounted on a first suction cup pivot pin, opposite ends of said first pivot pin attached to a pair of first suction cups, said first suction cups adapted for releasable attachment to an upper side of the guitar, said first tang, said first yoke and said first struts allow said arm rest pad to be pivoted in an "XY" vertical plane, a "YZ" vertical plane and a "XZ" horizontal plane for infinite adjustments by the guitar player;

a round ergonomically leg rest pad pivotally attached to a second tang, said second tang pivotally mounted on a second yoke, said second yoke pivotally attached to one end of a pair of second struts, an opposite end of said second struts pivotally mounted on a second suction cup pivot pin, opposite ends of said second pivot pin attached to a pair of second suction cups, said second suction cups adapted for releasable attachment to a lower side of the guitar, a bottom of said leg rest pad including a soft cushion thereon, said second tang, said second yoke and said second struts allow said leg rest pad to be pivoted in an "XY" vertical plane, a "YZ" vertical plane and a "XZ" horizontal plane for infinite adjustments by the guitar player; and an adjustable leg rest strap, one end of said strap attached to said leg rest pad, an opposite end of said strap attached to a clip, said clip adapted for attachment to an article of clothing on the guitar player.

16. The combination as described in claim 15 wherein said pair of first struts have different lengths for different height adjustments of said arm rest pad above the upper side of the guitar and in a "XY" vertical plane.

17. The combination as described in claim 15 wherein said pair of second struts have different lengths for different height adjustments of said leg rest pad above the lower side of the guitar and in a "XY" vertical plane.

18. The combination as described in claim 15 wherein said first and second yokes are three piece yokes having a yoke body, a removable yoke arm and a removable yoke base for attaching to different width tangs and different width struts.

19. The combination as described in claim 15 wherein said first and second pivot pins are received inside tubular spacers, two of said spacers received in a base of said first and second pair of suction cups, opposite ends of said first and second pivot pins attached to threaded nuts.

20. The combination as described in claim 19 wherein said first and second pivot pins are received inside a plurality of tubular spacers, at least one spacer is disposed on one side of the opposite end of said first and second struts and at least one spacer is disposed on an opposite side of the opposite end of said first and second struts, said spacer providing for lateral adjustment of said arm rest pad and said leg rest pad on the sides of the guitar.

* * * * *